US008385788B2

(12) United States Patent
Nishiyama

(10) Patent No.: US 8,385,788 B2
(45) Date of Patent: Feb. 26, 2013

(54) TONER CARTRIDGE HAVING LINEARLY MOVABLE SHUTTER MEMBER AND IMAGE FORMING DEVICE PROVIDED WITH THE SAME

(75) Inventor: Hideshi Nishiyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 77 days.

(21) Appl. No.: 13/170,349

(22) Filed: Jun. 28, 2011

(65) Prior Publication Data

US 2012/0020704 A1 Jan. 26, 2012

(30) Foreign Application Priority Data

Jul. 23, 2010 (JP) ..... 2010-165768

(51) Int. Cl.
*G03G 15/08* (2006.01)

(52) U.S. Cl. ..... 399/258

(58) Field of Classification Search ..... 399/253, 399/258, 260, 262
See application file for complete search history.

(56) References Cited

U.S. PATENT DOCUMENTS

| | | | | |
|---|---|---|---|---|
| 6,324,370 | B1 | 11/2001 | Isobe et al. | |
| 6,418,292 | B1 * | 7/2002 | Isobe et al. | 399/258 |
| 7,657,206 | B2 | 2/2010 | Sato | |
| 8,107,829 | B2 | 1/2012 | Sato et al. | |
| 2006/0067734 | A1 | 3/2006 | Igarashi et al. | |
| 2008/0025758 | A1 | 1/2008 | Sato | |
| 2009/0087215 | A1 | 4/2009 | Sakuma | |
| 2009/0087216 | A1 | 4/2009 | Sakuma | |
| 2009/0142079 | A1 | 6/2009 | Sato et al. | |
| 2009/0238608 | A1 * | 9/2009 | Murase et al. | 399/262 |

FOREIGN PATENT DOCUMENTS

| | | | |
|---|---|---|---|
| JP | H07-276883 | A | 10/1995 |
| JP | 09-269639 | | 10/1997 |
| JP | 09-269716 | | 10/1997 |
| JP | 2000-284557 | A | 10/2000 |
| JP | 2004-285191 | | 10/2004 |
| JP | 2006-098772 | | 4/2006 |
| JP | 2008-026830 | A | 2/2008 |
| JP | 2009-139489 | A | 6/2009 |
| JP | 2009271099 | A | 11/2009 |

* cited by examiner

*Primary Examiner* — Walter L Lindsay, Jr.
*Assistant Examiner* — Rodney Bonnette
(74) *Attorney, Agent, or Firm* — Banner & Witcoff, Ltd.

(57) ABSTRACT

An image forming device includes a movable holding member, a plurality of operation members and a plurality of developer cartridges detachably mountable on the holding member. The holding member has a plurality of photosensitive members and developing devices. Each operation members is disposed on the holding member in correspondence with each developing device. Each of the photosensitive member, the operation member and the developer cartridge extends in a first direction. Each developer cartridge is formed with an opening and has a shutter member linearly movable between an open position and a closed position in the first direction. The shutter member opens the opening at the open position to allow developer to flow and closes the opening at the closed position to prevent developer from flowing. Each operation member is linearly movable in the first direction to move the shutter member between the open position and the closed position.

8 Claims, 10 Drawing Sheets

TONER CARTRIDGE HAVING LINEARLY MOVABLE SHUTTER MEMBER AND IMAGE FORMING DEVICE PROVIDED WITH THE SAME

CROSS REFERENCE TO RELATED APPLICATION

This application claims priority from Japanese Patent Application No. 2010-165768 filed Jul. 23, 2010. The entire content of the priority application is incorporated herein by reference.

TECHNICAL FIELD

The present invention relates to an image forming device such as a laser printer.

BACKGROUND

A well-known tandem color laser printer includes a plurality of photosensitive drums each corresponding to one of four colors of yellow, magenta, cyan and black, and a plurality of developing cartridges for supplying toner of respective colors to the corresponding photosensitive drums.

Such conventional developing cartridges are detachably mountable on a drawer unit that integrally supports the plurality of photosensitive drums. Each developing cartridge accommodates toner therein and includes a developing roller and a supply roller.

SUMMARY

When the toner is used up, the developing cartridge needs to be replaced. This means that the developing roller and the supply roller are also to be replaced even though these rollers are still durable for use. Therefore, cost reduction at the time of replacing toner cannot be realized.

To this effect, there has been proposed such a technique that the conventional developing cartridge is separated into a toner cartridge for accommodating toner therein and a developing device unit including the developing roller and the supply roller. With this configuration, only the toner cartridge can be replaced when the toner is used up.

On the toner cartridge separable from the developing device unit, a shutter needs to be provided so that toner flow from the toner cartridge to the developing device unit can be permitted or restricted. The shutter needs to be opened and closed when the toner cartridge is mounted on or detached from the drawer unit.

In order to open and close the shutter, an operation member may be provided at an upper portion of the toner cartridge. However, if the operation member is provided at the upper portion of the toner cartridge, the drawer unit is applied with a force from above when a user manipulates the operation member for replacing the toner cartridge. As a result, there may be a danger that the printer accommodating the drawer unit could lose a balance and tip over.

In view of the foregoing, it is an object of the present invention to provide an image forming device capable of preventing a fall thereof at the time of replacement of toner cartridges.

In order to achieve the above and other objects, the present invention provides an image forming device including a main body, a holding member, a plurality of operation members and a plurality of developer cartridges. The holding member is movable relative to the main body between an accommodated state and a withdrawn state, the holding member being accommodated within the main body in the accommodated state and being pulled out from the main body in the withdrawn state, the holding member having therein a plurality of photosensitive members and a plurality of developing devices each corresponding to each photosensitive member, each photosensitive member extending in a first direction. The plurality of operation members is disposed on the holding member, each operation member extending in the first direction and disposed in one-to-one correspondence with the plurality of developing devices. The plurality of developer cartridges is detachably mountable on the holding member in one-to-one correspondence with the plurality of developing devices, each developer cartridge extending in the first direction and storing developer therein, each developer cartridge being formed with an opening and having a shutter member linearly movable between an open position and a closed position in the first direction, the shutter member opening the opening at the open position to allow the developer to flow to the corresponding developing device and closing the opening at the closed position to prevent the developer from flowing out of the developer cartridge, each operation member being linearly movable in the first direction to move the shutter member between the open position and the closed position.

DETAILED DESCRIPTION

<General Configuration of Color Laser Printer 1>

First, a general configuration of a direct-tandem type color laser printer 1 according to an embodiment of the present invention will be described with reference to FIG. 1.

In the following description, a left side in FIG. 1 will be referred to as a front side, while a right side in FIG. 1 will be referred to as a rear side. The terms "upward", "downward", "upper", "lower", "above", "below", "beneath", "right", "left", "front", "rear" and the like will be used assuming that the color laser printer 1 is viewed from its front side. That is, a near side in FIG. 1 will be referenced as a right side, while a far side in FIG. 1 will be referenced as a left side.

Figure 1:
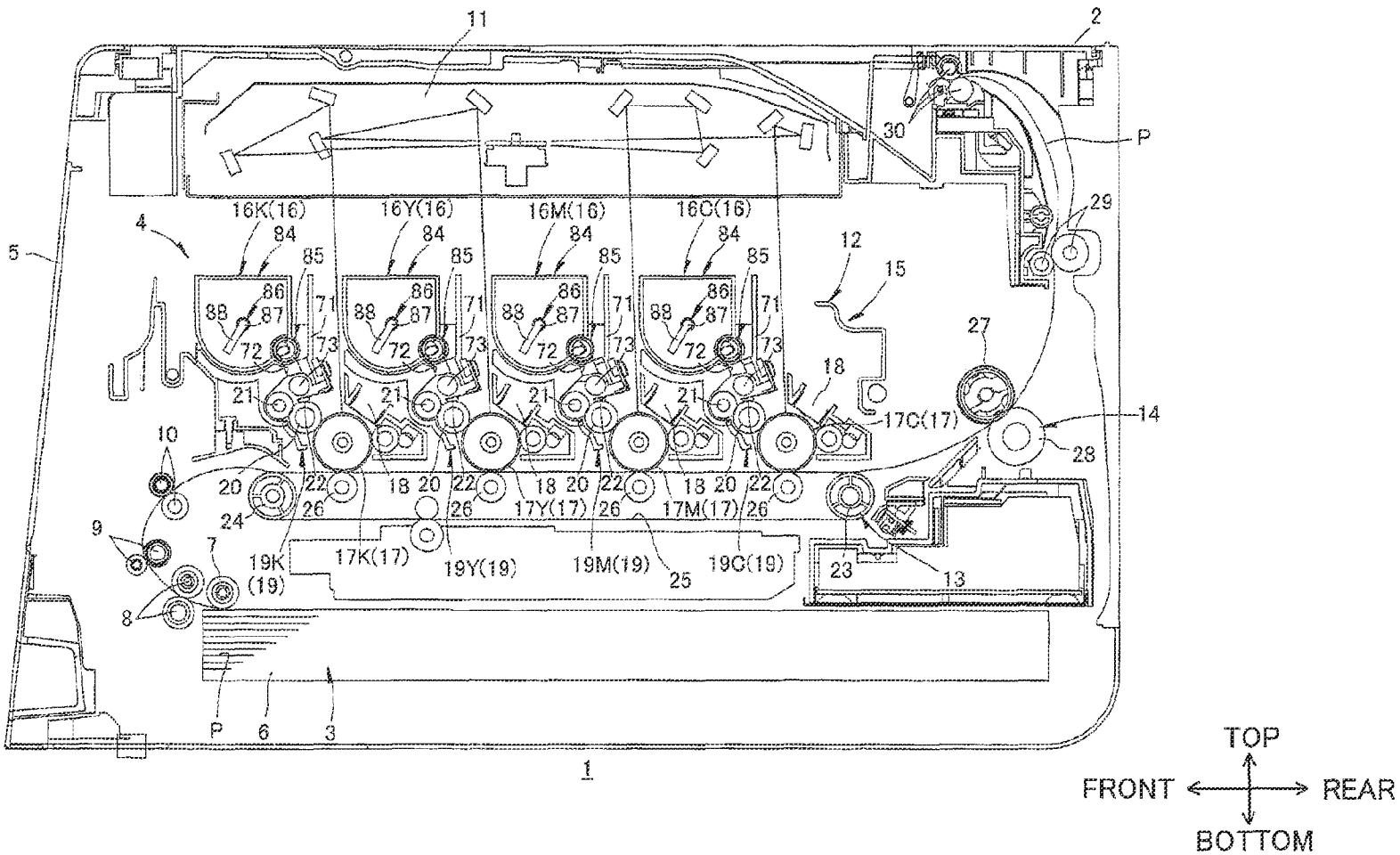
FIG. 1 is a cross-sectional view of a color laser printer according to an embodiment of the present invention, the color laser printer incorporating a drawer unit in which a plurality of toner cartridges is mounted.

As shown in FIG. 1, the color laser printer 1 includes a main casing 2 within which a sheet feeding unit 3 and an image forming unit 4 are disposed.

The main casing 2 is formed in a box shape having a substantially rectangular shape in a side view. A front cover 5 is pivotably movably provided at a lower end of the front side of the main casing 2.

The sheet feeding unit 3 includes a sheet tray 6 for accommodating sheets P therein. The sheet tray 6 is detachable relative to the main casing 2 and is disposed at a lower end of the main casing 2. The sheet feeding unit 3 further includes a pick-up roller 7, a pair of feeding rollers 8, a pair of conveying rollers 9 and a pair of registration rollers 10. The pick-up roller 7 and the feeding rollers 8 are disposed upward and frontward of the sheet tray 6. The conveying rollers 9 and the registration rollers 10 are disposed upward of the feeding rollers 8.

The sheets P accommodated within the sheet tray 6 are separated one by one by the pick-up roller 7, fed toward a position between the pair of registration rollers 10 by the feeding rollers 8 and the conveying rollers 9, and conveyed toward the image forming unit 4 at a prescribed timing by the registration rollers 10.

The image forming unit 4 includes a scanner unit 11, a process unit 12, a transfer unit 13, and a fixing unit 14.

The scanner unit 11 is disposed at an upper portion of the main casing 2. The scanner unit 11 irradiates a laser beam toward each of four photosensitive drums 17 (described later) based on image data, as indicated by solid lines in FIG. 1, to expose a surface of each photosensitive drum 17.

The process unit 12 is disposed below the scanner unit 11 and above the transfer unit 13. The process unit 12 includes a drawer unit 15 in which four toner cartridges 16 corresponding to four colors of toner are detachably mountable.

The drawer unit 15 is slidable relative to the main casing 2. Specifically, the process unit 12 slidingly moves between an accommodated position where the process unit 12 is accommodated within the main casing 2 and a withdrawn position where the process unit 12 is pulled out from the main casing 2.

Figure 2:
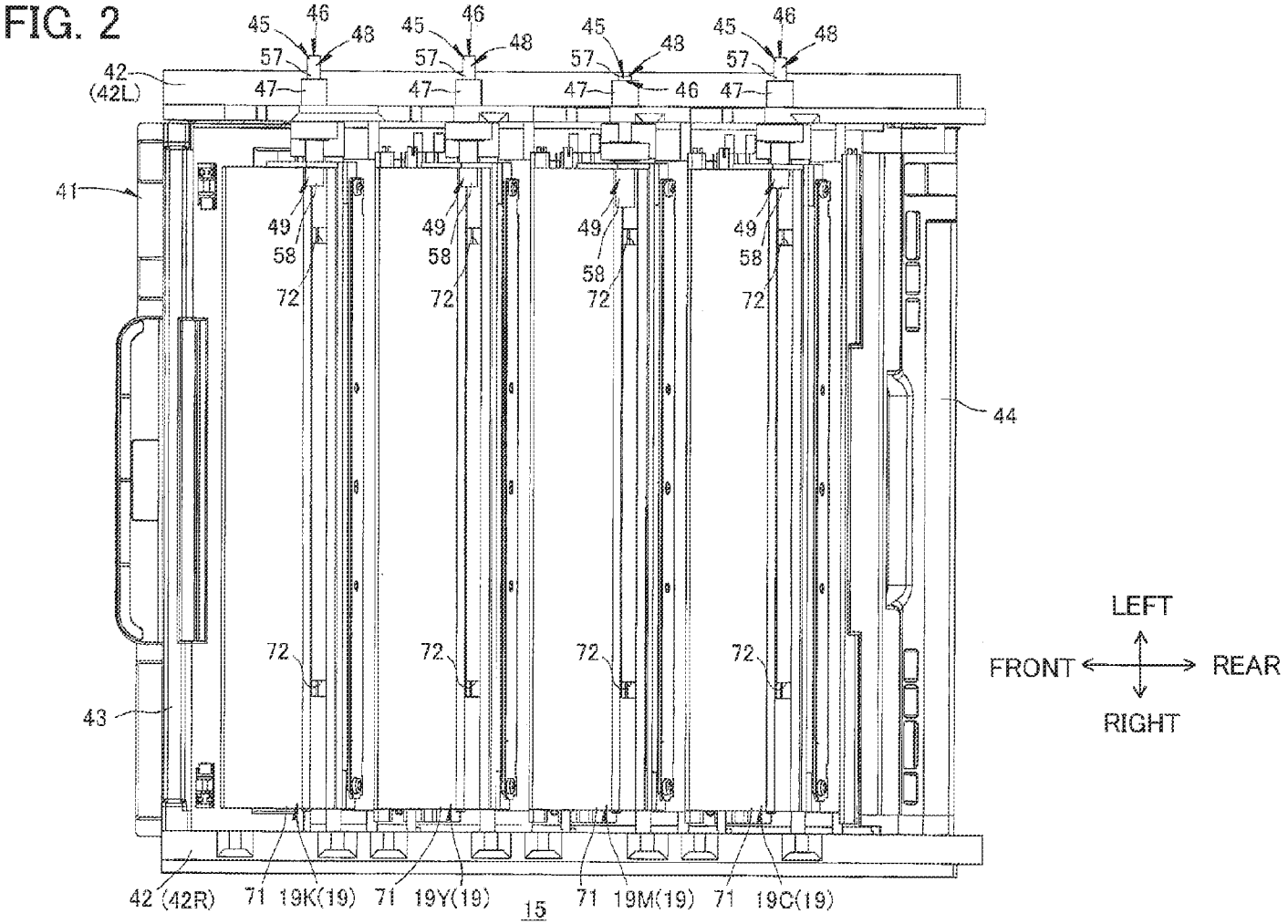
FIG. 2 is a plan view of the drawer unit shown in FIG. 1, the drawer unit including a plurality of operation sections each including an operation member and a supporting cylinder.

In the drawer unit 15, four sets of the photosensitive drum 17, a Scorotron charger 18 and a developing device unit 19 are arranged in a front-to-rear direction as shown in FIGS. 1 and 2.

Each photosensitive drum 17 has a cylindrical shape, extending in a left-to-right direction. The four photosensitive drums 17 are juxtaposed in the front-to-rear direction at regular intervals. Specifically, the photosensitive drum for black 17K, the photosensitive drum for yellow 17Y, the photosensitive drum for magenta 17M and the photosensitive drum for cyan 17C are sequentially arranged in the drawer unit 15 in the front-to-rear direction in the order mentioned above.

The Scorotron charger 18 is disposed at a position diagonally upward and rearward of the corresponding photosensitive drum 17 with a predetermined distance therefrom.

Each developing device unit 19 is supported to the drawer unit 15 so as to face the corresponding photosensitive drum 17 at a position diagonally upward and frontward of the photosensitive drum 17. Specifically, the developing device unit for black 19K, the developing device unit for yellow 19Y, the developing device unit for magenta 19M and the developing device unit for cyan 19C are sequentially disposed in correspondence with the photosensitive drum for black 17K, the photosensitive drum for yellow 17Y, the photosensitive drum for magenta 17M and the photosensitive drum for cyan 17C respectively in the front-to-rear direction.

Each developing device unit 19 includes a developing roller 20. The developing roller 20 is disposed at a lower end portion of the developing device unit 19 and is rotatably supported thereto such that a rear portion of the developing roller 20 is exposed from the developing device unit 19. The rear portion of the developing roller 20 exposed from the developing device unit 19 is in contact with the corresponding photosensitive drum 17 at a position diagonally upward and frontward thereof.

Each developing device unit 19 further includes a supply roller 21 and a thickness regulation blade 22. The supply roller 21 supplies toner to the corresponding developing roller 20, and the thickness regulation blade 22 maintains the toner supplied on the developing roller 20 at a uniform thickness.

The four toner cartridges 16 are detachably supported in the drawer unit 15 such that each toner cartridge 16 is mounted on the developing device unit 19 of the corresponding color from above. Specifically, each toner cartridge 16 stores therein toner of one of the four colors, and the toner cartridge for black 16K, the toner cartridge for yellow 16Y, the toner cartridge for magenta 16M and the toner cartridge for cyan 16C are mountable on the developing device unit for black 19K, the developing device unit for yellow 19Y, the developing device unit for magenta 19M and the developing device unit for cyan 19C respectively.

The toner stored in each toner cartridge 16 is supplied to the supply roller 21 and then to the developing roller 20 of the same color. The toner is positively charged between the supply roller 21 and the developing roller 20.

As the developing roller 20 rotates, the toner borne on the developing roller 20 is maintained thereon as a thin layer of uniform thickness by the thickness regulation blade 22.

In the meantime, as each photosensitive drum 17 rotates, the corresponding Scorotron charger 18 uniformly charges the surface of the photosensitive drum 17 and the laser beam from the scanner unit 11 then exposes the charged surface of the photosensitive drum 17 at a high speed. An electrostatic latent image in accordance with the image data is thus formed on the surface of each photosensitive drum 17.

As each photosensitive drum 17 further rotates, the positively-charged toner carried on each developing roller 20 is supplied to the electrostatic latent image formed on the surface of the corresponding photosensitive drum 17, thereby developing the electrostatic latent image into a visible toner image on the surface of the photosensitive drum 17.

The transfer unit 13 is disposed above the sheet feeding unit 3 and below the process unit 12 within the main casing 2. The transfer unit 13 extends in the front-to-rear direction and includes a drive roller 23, a follower roller 24, a conveyor belt 25, and four transfer rollers 26.

The drive roller 23 and the follower roller 24 are arranged in opposition to each other in the front-to-rear direction and are spaced away from each other by a prescribed distance.

The conveyor belt 25 is an endless belt mounted on the drive roller 23 and the follower roller 24 in a taut state. An upper portion of the conveyor belt 25 is in confrontation with and in contact with each of the photosensitive drums 17. As the drive roller 23 rotates, the conveyor belt 25 is circularly moved in the front-to-rear direction.

Each transfer roller 26 is disposed within an internal space of the endless conveyor belt 25 such that each transfer roller 26 opposes each photosensitive drum 17 via the upper portion of the conveyor belt 25.

While the sheet P supplied from the sheet feeding unit 3 is conveyed along the upper portion of the conveyor belt 25, the sheet P sequentially passes each transfer position at which each photosensitive drum 17 and each transfer roller 26 are in confrontation with each other. As the sheet P passes the transfer positions, the toner images of each color formed on the surfaces of respective photosensitive drums 17 are sequentially superimposed on the sheet P, thereby forming a colored toner image on the sheet P.

The fixing unit 14 is disposed rearward of the transfer unit 13. The fixing unit 14 includes a heat roller 27 and a pressure roller 28 opposing the heat roller 27. The colored toner image transferred onto the sheet P is thermally fixed thereon by heat generated by the heat roller 27 and pressure applied from the pressure roller 28, while the sheet P passes between the heat roller 27 and the pressure roller 28.

The sheet P on which the colored toner image has been fixed is conveyed by various discharge rollers 29 and 30, while making a U-turn. The image-formed sheet P is finally discharged onto a discharge tray 31 formed on an upper surface of the main casing 2.

<Detailed Configuration of the Drawer Unit 15>

Next, a detailed configuration of the drawer unit 15 will be described with reference to FIGS. 2 through 3C.

As shown in FIG. 2, the drawer unit 15 includes a drawer frame 41 having a substantially rectangular frame-like shape in a plan view. Each developing device unit 19 is supported to the drawer frame 41.

The drawer frame 41 is configured of a pair of side plates 42 (a right side plate 42R and a left side plate 42L), a front beam 43 and a rear beam 44. The front beam 43 extends in the left-to-right direction and connects front end portions of the right side plate 42R and the left side plate 42L. The rear beam 44 extends in the left-to-right direction and connects rear end portions of the right side plate 42R and the left side plate 42L.

Each of the right side plate 42R and left side plate 42L has a flat plate-like shape extending in the front-to-rear direction. The both side frames 42R, 42L are in opposition to and in separation from each other in the left-to-right direction. The four sets of the photosensitive drum 17, the Scorotron charger 18 and the developing device unit 19 are supported so as to be interposed between the right side plate 42R and left side plate 42L in the left-to-right direction.

The left side plate 42L is provided with four operation sections 45. Each operation section 45 includes an operation member 46 and a supporting cylinder 47.

Figure 3A:
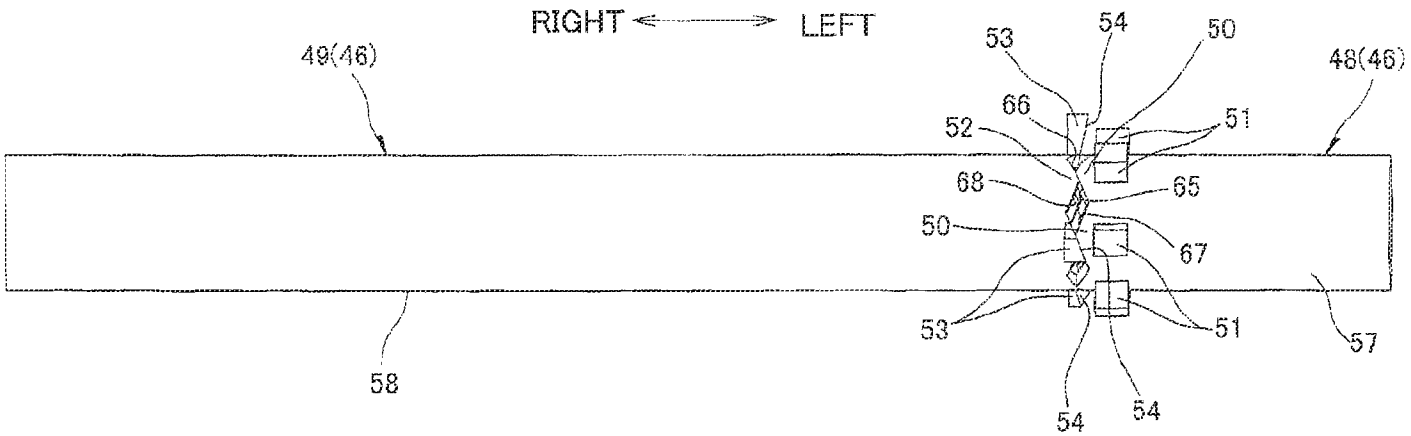
FIG. 3A is a plan view of the operation member, the operation member including a first operation member and a second operation member.
Figure 3C:
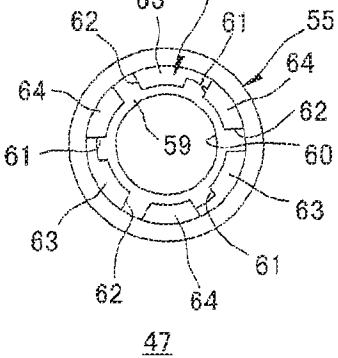
FIG. 3C is a right side view of the supporting cylinder.

As shown in FIG. 3A, the operation member 46 is configured of a first operation member 48 and a second operation member 49.

The first operation member 48 has a substantially cylindrical shape extending in the left-to-right direction. The first operation member 48 includes a first shaft member 57 and six first protruding portions 51.

The first shaft member 57 has a substantially cylindrical shape extending in the left-to-right direction. The first shaft member 57 has a left end portion protruding leftward from the left side plate 42L of the drawer frame 41 (see FIG. 2) and a right end portion on which gear teeth 50 are formed.

As shown in FIG. 3A, each gear tooth 50 is formed in a substantially triangular shape whose apex or summit is directed rightward.

Each gear tooth 50 includes a first gear tooth face 65 and a second gear tooth face 67. The first gear tooth face 65 is gradually directed leftward in a clockwise direction in a right side view. The second gear tooth face 67 is gradually directed leftward in a counterclockwise direction in the right side view. In other words, in FIG. 3A, each first gear tooth face 65 has one end at a rightmost summit and another end at a leftmost valley, and each second gear tooth face 67 has one end connected to the other end of the first gear tooth face 65 at the leftmost valley, and another end connected to one end of a next rightmost summit. As viewed from the right, the first gear tooth face 65 slopes downward to reach the valley and the second gear tooth face 67 slopes upward to reach the summit in the clockwise direction.

Each first protruding portion 51 is formed in a substantially prismatic columnar shape and protrudes in a radial direction of the operation member 46 (i.e., a radial direction of the first shaft member 57) from an outer circumferential surface of the right end portion of the first shaft member 57. Specifically, each first protruding portion 51 is positioned at regular intervals along a circumference of the right end portion of the first shaft member 57, i.e., each interval being at sixty degrees (60°) with respect to the circumference.

The second operation member 49 has a substantially cylindrical shape extending in the left-to-right direction. The second operation member 49 includes a second shaft member 58 and three second protruding portions 53.

The second shaft member 58 is formed in a substantially cylindrical shape extending in the left-to-right direction to have a length longer than that of the first shaft member 57. The second shaft member 58 has a right end portion that is inserted into the corresponding toner cartridge 16 (see FIGS. 9 and 10), and a left end portion on which gear teeth 52 are formed. The gear teeth 52 are engageable with the gear teeth 50 of the first operation member 48.

Each gear tooth 52 is formed in a substantially triangular shape whose apex angle or summit is directed leftward.

Each gear tooth 52 includes a first gear tooth face 66 and a second gear tooth face 68. The first gear tooth face 66 is gradually directed rightward in a clockwise direction in a left side view. The second gear tooth face 68 is gradually directed rightward in a counterclockwise direction in the left side view. In other words, in FIG. 3A, each first gear tooth face 66 has one end at a rightmost valley and another end at a leftmost summit, and each second gear tooth face 68 has one end connected to the other end of the first gear tooth face 66 at the leftmost summit, and another end connected to one end of a next rightmost valley. As viewed from the left, the first gear tooth face 66 slopes upward to reach the summit and the second gear tooth face 68 slopes downward to reach the valley in the counterclockwise direction.

Each second protruding portion 53 is formed in a substantially prismatic columnar shape, and protrudes in the radial direction of the operation member 46 (i.e., a radial direction of the second shaft member 58) from an outer circumferential surface of the left end portion of the second shaft member 58. Specifically, each second protruding portion 53 is positioned at regular intervals along a circumference of the left end portion of the second shaft member 58, each interval being at a hundred twenty degrees (120°) with respect to the circumference.

Each second protruding portion 53 has a protruding length longer than that of each first protruding portion 51 in the radial direction of the operation member 46. Each second protruding portion 53 has a left end surface 54 that gradually slopes leftward in the clockwise direction as viewed from the right side. The left end face 54 serves as an abutment surface 54 that is engageable with one of first sloped sections 63 and second sloped sections 64 formed on the supporting cylinder 47, as will be described later.

Figure 3B:
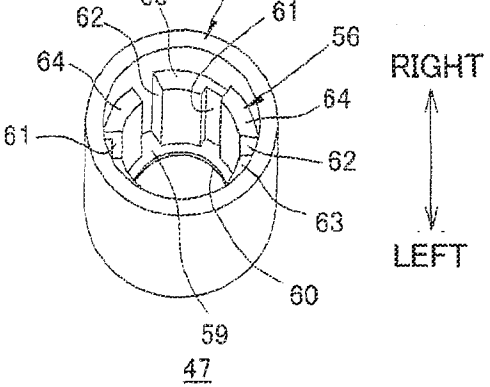
FIG. 3B is a perspective view of the supporting cylinder.

The supporting cylinder 47 extends in the left-to-right direction and has a substantially cylindrical shape, as shown in FIG. 3B. The supporting cylinder 47 integrally includes an outer cylinder 55 and an inner cylinder 56.

The outer cylinder 55 extends in the left-to-right direction and is formed in a substantially cylindrical tubular shape. The outer cylinder 55 has a left end portion on which a restricting wall 59 is formed.

The restricting wall 59 is formed in a substantially disk-shape and extends radially inward so as to close the left end portion of the outer cylinder 55. The restricting wall 59 is formed with a through-hole 60 at a position center of the restricting wall 59. The through-hole 60 has a substantially circular shape whose center is coincident with a center of the outer cylinder 55. The through-hole 60 is capable of receiving therein the first shaft member 57 of the first operation member 48, but incapable of receiving the first protruding portions 51 of the first operation member 48.

The outer cylinder 55 has an inner circumferential surface on which the inner cylinder 56 is formed.

The inner cylinder 56 has a substantially cylindrical tubular shape extending in the left-to-right direction. The inner cylinder 56 is positioned at or deviated to a left inner peripheral surface portion of the outer cylinder 55 and protrude radially inward from the same. The inner cylinder 56 has an inner circumferential surface on which three first grooves 61 and three second grooves 62 are formed. Each of the first grooves 61 and the second grooves 62 extends in the left-to-right direction.

Each first groove 61 extends radially outward from the inner circumferential surface of the inner cylinder 56 to a midway in a radial direction of the inner cylinder 56. The first grooves 61 are capable of receiving the first protruding portions 51 of the first operation member 48, but incapable of receiving the second protruding portions 53 of the second operation member 49. The first grooves 61 are spaced away from one another at substantially equi-intervals, more specifically, at regular intervals of substantially a hundred twenty degrees (120°) in a circumferential direction of the inner cylinder 56.

Each second groove 62 extends from the inner circumferential surface of the inner cylinder 56 to the inner circumferential surface of the outer cylinder 55 in the radial direction of the inner cylinder 56, i.e., spans an entire length of the inner cylinder 56 in the radial direction of the inner cylinder 56. The second grooves 62 are capable of receiving the first protruding portions 51 of the first operation member 48 and the second protruding portions 53 of the second operation member 49. The second grooves 62 are arranged such that each second groove 62 is interposed between the neighboring first grooves 61 in the circumferential direction of the inner cylinder 56 and that the second grooves 62 are spaced away from one another in the circumferential direction of the inner cylinder 56 at substantially equi-intervals, more specifically, at regular intervals of substantially a hundred twenty degrees (120°). In other words, the second grooves 62 and the first grooves 61 are alternately arranged with one another in the circumferential direction of the inner cylinder 56, shown in FIG. 3C.

When each second protruding portion 53 of the second operation member 49 is fitted in each second groove 62, the gear teeth 50 of the first operation member 48 and the gear teeth 52 of the second operation member 49 are not completely engaged with each other. More specifically, each of the second protruding portions 53 is arranged to be positioned such that, when each second protruding portion 53 is fitted with the second grove 62 of the supporting cylinder 47, each of the gear teeth 50 and each of the gear teeth 52 are in contact with each other such that each summit of the gear teeth 50 and each summit of the gear teeth 52 are adjacent to each other, and at the same time, the first gear tooth face 65 of the first operation member 48 and the first gear tooth face 66 of the second operation member 49 are in contact with each other.

The inner cylinder 56 has a right side surface on which three first sloped sections 63 and three second sloped sections 64 are formed. The three first sloped sections 63 and the three second sloped sections 64 alternately arranged with one another in the circumferential direction of the inner cylinder 56.

Each first sloped section 63 spans from a downstream end of each second groove 62 to a downstream end of each first groove 61 in the clockwise direction in a right side view. The first sloped section 63 slopes leftward in the clockwise direction as viewed from the right side such that the first sloped section 63 approaches the restricting wall 59 as extending away from the second groove 62.

Each second sloped section 64 spans from a downstream end of each first sloped section 63 to an upstream end of each second groove 62 in the clockwise direction in the right side view. The second sloped section 64 slopes leftward in the clockwise direction as viewed from the right side such that the second sloped section 64 approaches the restricting wall 59 as extending away from the first groove 61. Further, in the right side view, each second sloped section 64 has an upstream end in the clockwise direction that protrudes further rightward than the downstream end of each first sloped section 63.

Figure 4A:
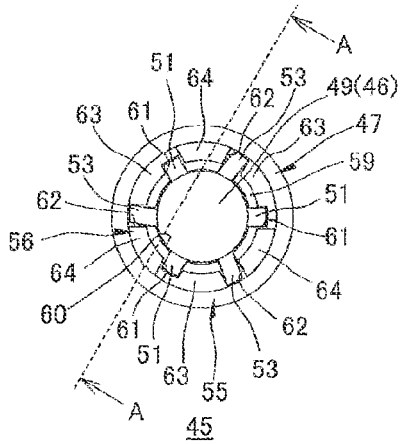
FIG. 4A is a right side view of the operation section in a state where the operation member is in a second position.
Figure 4B:
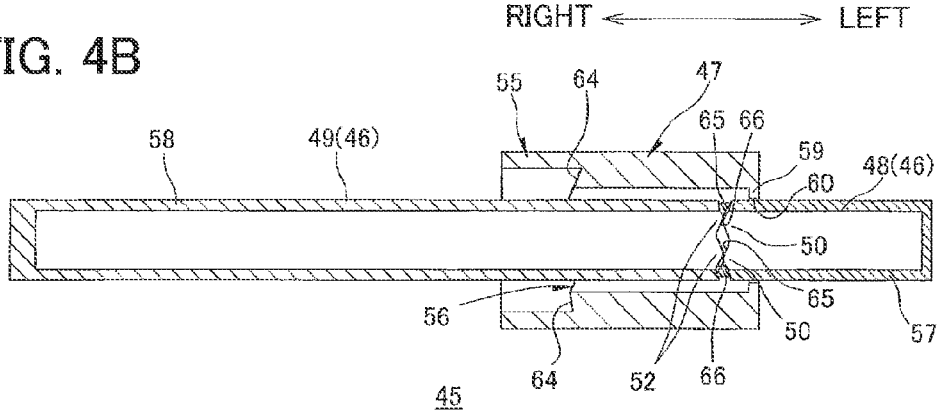
FIG. 4B is a cross-sectional view of the operation section taken along a line A-A shown in FIG. 4A.
Figure 4C:
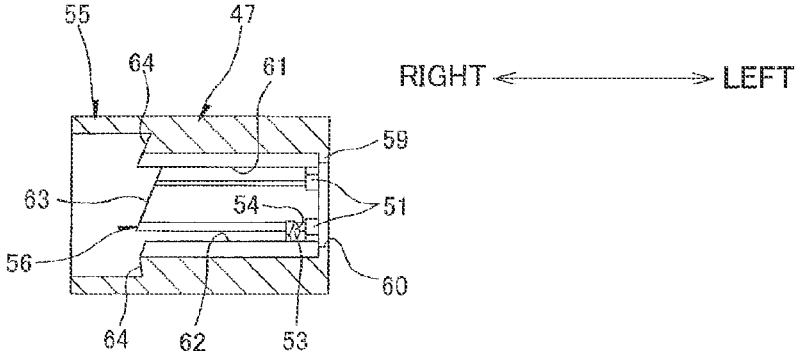
FIG. 4C is an explanatory view explaining engagement between the operation member and the supporting cylinder when the operation member is in the second position.

The first operation member 48 slidably penetrates through the supporting cylinder 47 such that the left end portion of the first shaft member 57 is inserted into the through-hole 60 of the supporting cylinder 47 from rightward thereof and each first protruding portion 51 is fitted with respective one of the first grooves 61 and the second grooves 62, as shown in FIGS. 4A through 4C.

At this time, each gear tooth 50 of the first operation member 48 and each gear tooth 52 of the second operation member 49 are in abutment with one another at a position adjacent to each summit such that each first gear tooth face 65 of the first operation member 48 and each first gear tooth face 66 of the second operation member 49 are in abutment with one another.

The second operation member 49 is constantly biased leftward by a biasing member (not shown). Therefore, as shown in FIG. 4B, the operation member 46 is normally in a second position where the right end portion of the first operation member 48 is positioned at the left end portion of the supporting cylinder 47 (adjacent to the restricting wall 59) and the left end portion of the second operation member 49 is placed within the inner cylinder 56. At this time, the first protruding portions 51 are in abutment with the restricting wall 59 from rightward thereof, thereby restricting the operation member 46 from coming off leftward from the supporting cylinder 47.

The entire operation member 46 is slidably moved (linearly moved) rightward from the second position to a first position (FIG. 7B) where the right end portion of the first operation member 48 is placed at a right end portion of the inner cylinder 56 and the left end portion of the second operation member 49 is placed rightward of the inner cylinder 56 against a biasing force of the biasing member (not shown).

<Operations of the Operation Members 46>

Next, operations to move the operation member 46 from the second position to the first position will be described with reference to FIGS. 4A through 7C.

First, a user pushes the first operation member 48 rightward when the operation member 46 is in the second position (FIG. 4B). The first operation member 48 and the second operation member 49 are integrally slidingly moved rightward.

Figure 5A:
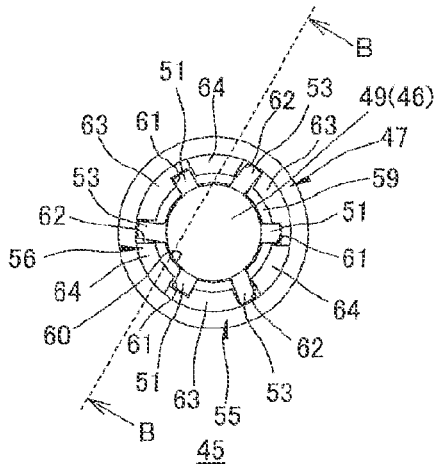
FIG. 5A is a right side view of the operation section in a state where the operation member is being moved to a first position from the second position after the state shown in FIG. 4A.
Figure 5B:
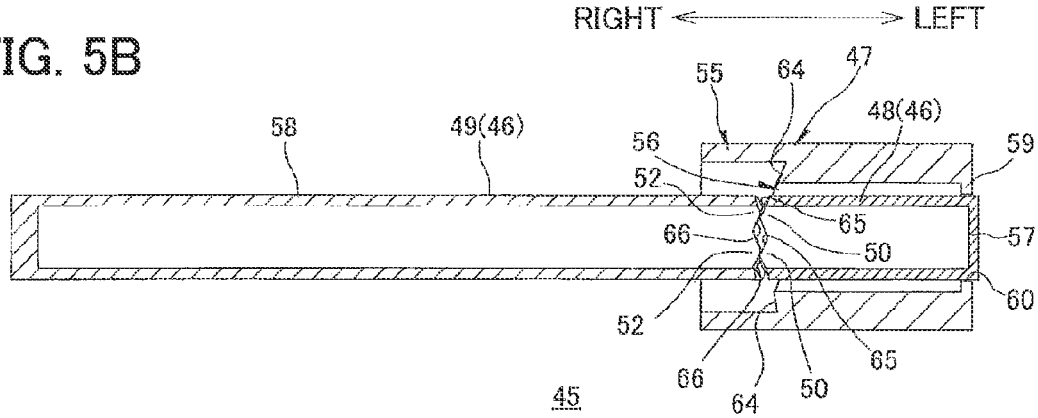
FIG. 5B is a cross-sectional view of the operation section taken along a line B-B shown in FIG. 5A.
Figure 5C:
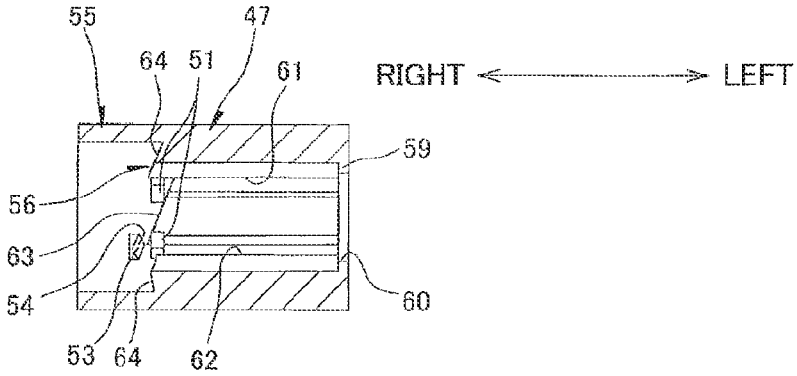
FIG. 5C is an explanatory view explaining engagement between the operation member and the supporting cylinder when the operation member is being moved to the first position from the second position.

Then, as shown in FIG. 5B, the first operation member 48 is pushed into the supporting cylinder 47 until the right end portion of the first operation member 48 is aligned with the right end portion of the inner cylinder 56 in the radial direction of the operation member 46. The operation member 46 is moved to the first position and the second protruding portions 53 of the second operation member 49 are disengaged from the second grooves 62 of the inner cylinder 56.

As a result, due to the biasing force of the biasing member (not shown), the second operation member 49 is pushed leftward such that the first gear tooth faces 66 of the second operation member 49 are slidingly moved relative to the first gear tooth faces 65 of the first operation member 48. The second operation member 49 is rotated in the clockwise direction so that the first operation member 48 and the second operation member 49 are completely in engagement with each other, as shown in FIG. 6B.

Figure 6A:
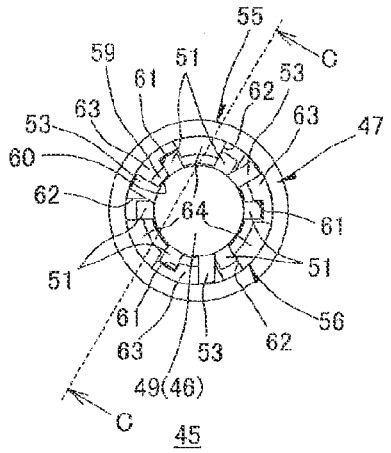
FIG. 6A is a right side view of the operation section in a state where the first operation member is completely engaged with the second operation member after the state shown in FIG. 5A.
Figure 6B:
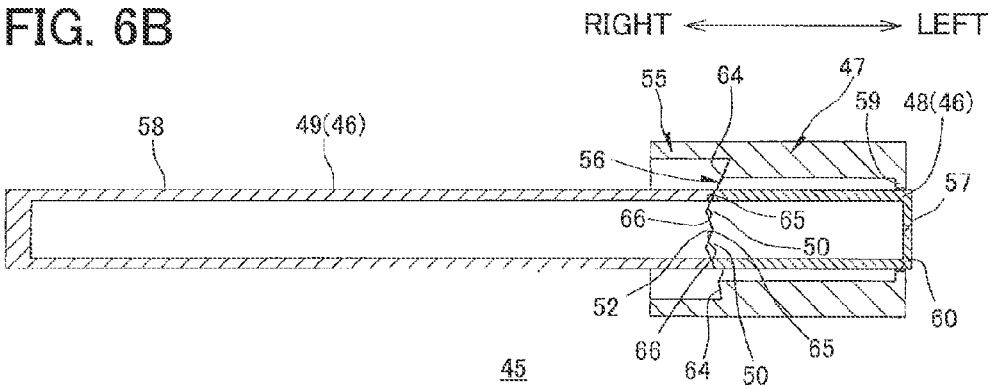
FIG. 6B is a cross-sectional view of the operation section taken along a line C-C shown in FIG. 6A.
Figure 6C:
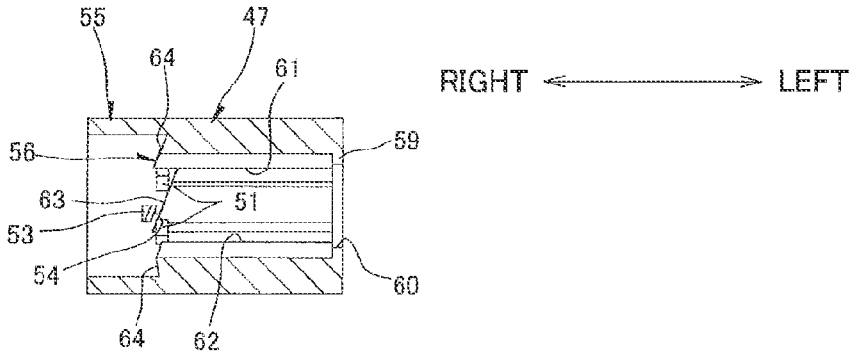
FIG. 6C is an explanatory view explaining engagement between the operation member and the supporting cylinder when the first operation member is completely engaged with the second operation member.

At this time, as shown in FIGS. 6A and 6C, each second protruding portion 53 of the second operation member 49 is positioned rightward of each first sloped section 63 of the inner cylinder 56 in the clockwise direction in the right side view.

Then, when the first operation member 48 is released from being pushed, due to the biasing force of the biasing member (not shown), the second operation member 49 is pushed leftward so that the abutment surface 54 of each second protruding portion 53 is brought into abutment with each first sloped section 63.

Figure 7A:
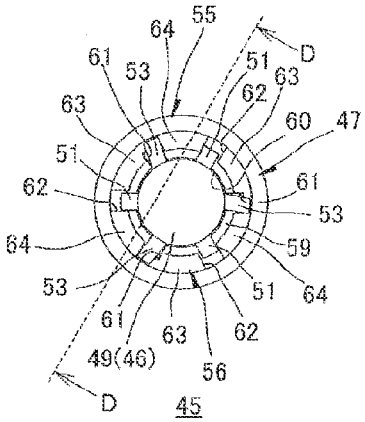
FIG. 7A is a right side view of the operation section in a state where the operation member is held at the first position after the state shown in FIG. 6A.
Figure 7B:
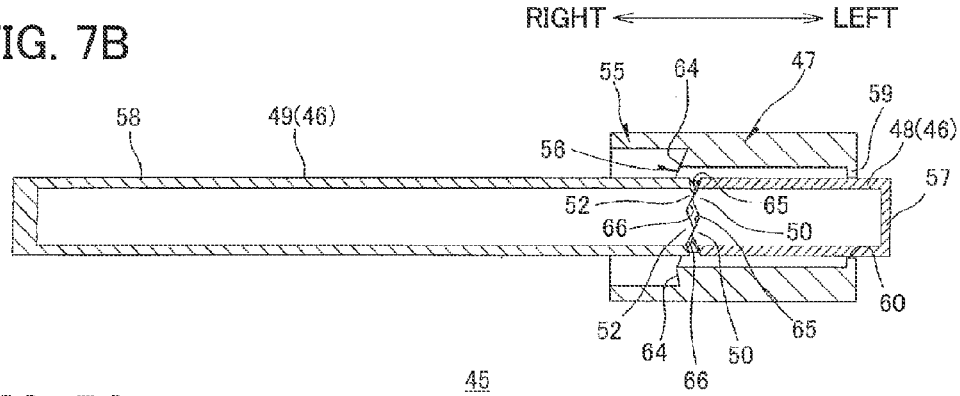
FIG. 7B is a cross-sectional view of the operation section taken along a line D-D shown in FIG. 7A.
Figure 7C:
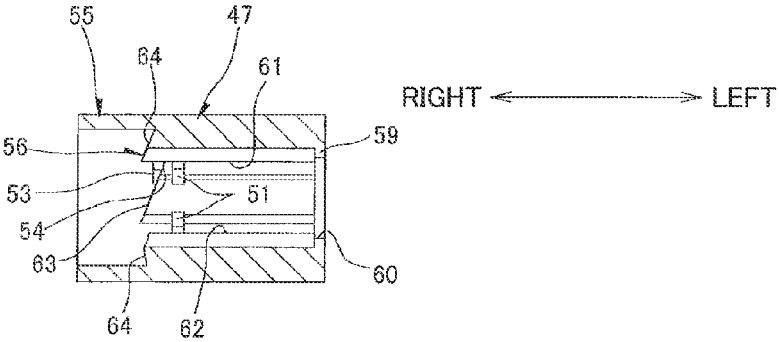
FIG. 7C is a view explaining engagement between the operation member and the supporting cylinder when the operation member is held at the first position.

As the second operation member 49 is further pushed leftward due to the biasing force of the biasing member (not shown), each second protruding portion 53 is slidingly moved along each first sloped section 63 so that the second operation member 49 is rotated in the clockwise direction in the right side view, as shown in FIGS. 7A and 7C.

When each second protruding portion 53 is brought into abutment with the upstream end of each second sloped section 64 at a position rightward of each first groove 61, the second operation member 49 is prevented from being rotated further in the clockwise direction. At this time, each second protruding portion 53 is not fitted with (coupled to) each first groove 61, but is in contact with a right end portion of the first groove 61. The second operation member 49 is therefore restricted from being moved to the second position from the first position.

Further, at this time, the gear teeth 50 of the first operation member 48 and the gear teeth 52 of the second operation member 49 are not completely engaged with each other, as shown in FIG. 7B. Instead, the gear teeth 50 of the first operation member 48 and the gear teeth 52 of the second operation member 49 are in contact with each other at a position adjacent to each summit such that each first gear tooth face 65 of the first operation member 48 and each first gear tooth face 66 of the second operation member 49 are in abutment with one another.

In order to move the operation member 46 from the first position to the second position, the user pushes the first operation member 48 rightward when the first operation member 48 is in the first position.

The first operation member 48 and the second operation member 49 are integrally slidingly moved rightward. The first operation member 48 is pushed into the supporting cylinder 47 until the right end portion of the first operation member 48 is aligned with the right end portion of the inner cylinder 56 in the radial direction of the operation member 46. As a result, each second protruding portion 53 of the second operation member 49 is disengaged from the upstream end of each second sloped section 64, permitting the second operation member 49 to rotate in the clockwise direction in the right side view.

Due to the biasing force of the biasing member (not shown), the second operation member 49 is pushed leftward. The second operation member 49 is rotated in the clockwise direction such that each first gear tooth face 66 is slidingly moved relative to each first gear tooth face 65 of the first operation member 48. In this way, the first operation member 48 and the second operation member 49 are completely in engagement with each other.

At this time, each second protruding portion 53 of the second operation member 49 is placed rightward of each second sloped section 64.

Then, when the first operation member 48 is released from being pushed, due to the biasing force of the biasing member (not shown), the second operation member 49 is pushed leftward so that the abutment surface 54 of each second protruding portion 53 is brought into abutment with each second sloped section 64.

As the second operation member 49 is further pushed leftward due to the biasing force of the biasing member (not shown), each second protruding portion 53 is slidingly moved along each second sloped section 64 in the clockwise direction.

As a result, at the downstream end of each second sloped section 64 in the clockwise direction, each second protruding portion 53 is coupled to each second groove 62 so that the operation member 46 is released from the restriction on its movement from the first position to the second position. Therefore, as shown in FIG. 4B, the operation member 46 is moved to the second position from the first position due to the biasing force of the biasing member (not shown).

<Detailed Configuration of the Developing Device Unit 19>

Each developing device unit 19 includes a developing device frame 71, as shown in FIGS. 1 and 2.

The developing device frame 71 is formed in a box shape extending in the left-to-right direction. The developing device frame 71 has a substantially isosceles triangular shape in a side view whose apex angle is facing downward and rearward. The developing device frame 71 has a bottom end portion that is open rearward. The developing roller 20 is rotatably supported to the bottom end portion of the developing device frame 71.

The developing device frame 71 has an upper wall that is open upward and formed in a substantially arcuate shape in a side view in conformance with an outer profile of the corresponding toner cartridge 16.

The developing device frame 71 has an upper peripheral end portion on which two developing openings 72 are formed. The two developing openings 72 are positioned in opposition to and in separation from each other in the left-to-right direction. Each developing opening 72 has a substantially rectangular shape in a plan view, extending in the left-to-right direction. Each developing opening 72 penetrates through the upper wall of the developing device frame 71 vertically for allowing toner from the toner cartridge 16 to flow to the developing device unit 19.

Within the developing device frame 71, a developing auger 73 is disposed (see FIG. 1). The developing auger 73 extends in the left-to-right direction and rotatably supported at a position below the developing openings 72. As the developing auger 73 rotates, the toner supplied from the toner cartridge 16 to the developing device frame 71 is conveyed from leftward to rightward.

Within the developing device frame 71, the supply roller 21 is disposed at a position diagonally downward and frontward of the developing auger 73 such that the supply roller 21 and the developing auger 73 are in separation from each other by a prescribed distance. The developing roller 20 is disposed so as to be in contact with the supply roller 21 at a position diagonally upward and rearward of the supply roller 21. The thickness regulation blade 22 is in contact with the developing roller 20 from above.

<Detailed Configuration of the Toner Cartridge 16>

Figure 8:
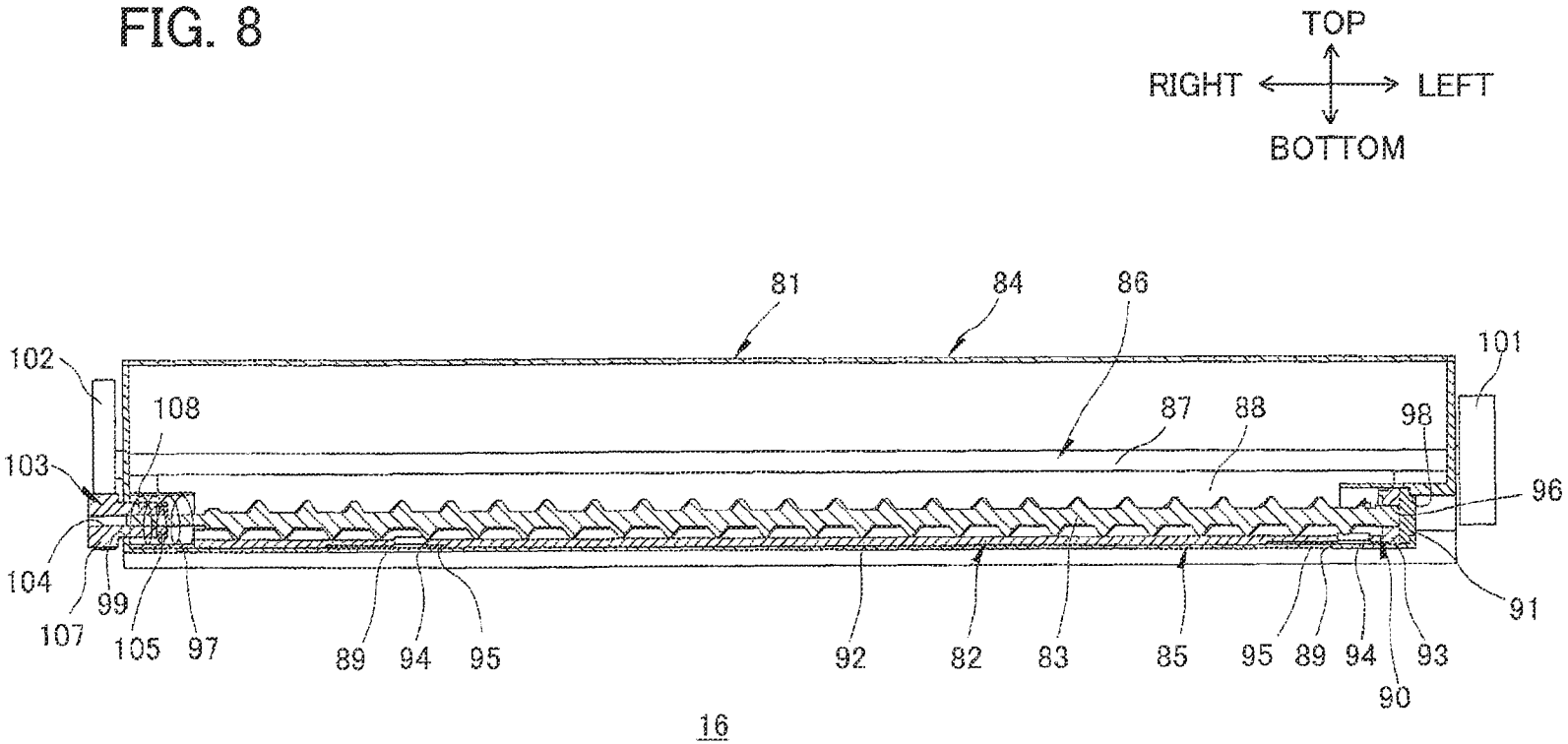
FIG. 8 is a vertical cross-sectional view of the toner cartridge shown in FIG. 1 as viewed from its rear side, the toner cartridge including a shutter member.

As shown in FIG. 8, the toner cartridge 16 includes a cartridge frame 81, a shutter member 82, a cartridge auger 83 and an auger driving gear 103.

The cartridge frame 81 is formed in a box shape extending in the left-to-right direction. The cartridge frame 81 integrally includes a toner accommodation section 84 for accommodating toner therein and a shutter accommodation section 85 for accommodating the shutter member 82 therein.

The toner accommodation section 84 has a box shape extending in the left-to-right direction. An agitator 86 is disposed within the toner accommodation section 84 for agitating toner accommodated in the toner accommodation section 84 (see FIGS. 1 and 8). The agitator 86 extends in the left-to-right direction and includes an agitator shaft 87 and a blade 88.

The agitator shaft 87 extends in the left-to-right direction and has widthwise end portions (left and right end portions) supported to left and right side walls of the cartridge frame 81 such that the agitator shaft 87 can rotate relative to the cartridge frame 81. The widthwise ends portions of the agitator shaft 87 penetrate through the left and right side walls of the cartridge frame 81 respectively to protrude outward from the toner cartridge 16.

The blade 88 extends from the agitator shaft 87 toward an inner circumferential surface of the toner cartridge 16.

The shutter accommodation section 85 is positioned below and rearward of the toner accommodation section 84 so as to be in fluid communication with the same. The shutter accommodation section 85 has a substantially hollow cylindrical shape, and has a substantially circular shape in a side view (see FIG. 1). The shutter accommodation section 85 is formed with two accommodation openings 89, a through-hole 98 for accepting the operation member 46, and a supporting hole 99 for supporting the auger driving gear 103, as shown in FIG. 8.

The accommodation openings 89 are formed on a lower end portion of the shutter accommodation section 85. Each accommodation opening 89 has a substantially rectangular shape in a plan view and is formed at a position coincident with each of the developing openings 72 of the developing device unit 19 in the left-to-right direction so as to allow the toner from the toner cartridge 16 to flow to the developing device unit 19.

The through-hole 98 is formed at a left end wall of the shutter accommodation section 85 and is capable of receiving therein the right end portion of the second operation member 49.

The supporting hole 99 is formed at a right end wall of the shutter accommodation section 85. The supporting hole 99 has a substantially circular shape in a side view whose center is coincident with a center of the shutter accommodation section 85. The supporting hole 99 is capable of receiving therein the auger driving gear 103, more specifically, an auger supporting portion 108 (described later) of the auger driving gear 103.

The shutter member 82 is formed in a substantially hollow cylindrical shape, and includes a cylindrical portion 90 and a contact portion 91.

The cylindrical portion 90 is integrally configured of a covering portion 92 and a bearing portion 93. The covering portion 92 extends in the left-to-right direction and partially has a hollow cylindrical shape in conformance with an outer profile of the cartridge auger 83 so as to be in confrontation with an inner circumferential surface of the lower end portion of the shutter accommodation section 85. The covering portion 92 is formed with two shutter openings 94. Each shutter opening 94 has a substantially rectangular shape in a plan view, and is positioned to be in coincidence with each accommodation opening 89 in the left-to-right direction.

The covering portion 92 has an outer circumferential surface to which two toner seals 95 are attached. Each toner seal 95 is provided to surround each shutter opening 94 so that the toner can be prevented from leaking between the shutter accommodation section 85 and the covering portion 92.

The bearing portion 93 is provided at a left end portion of the covering portion 92 to be in continuous with the same. The bearing portion 93 extends in the left-to-right direction and has a substantially cylindrical shape whose central axis is coincident with a central axis of the covering portion 92. The bearing portion 93 has a left end portion that is closed but is formed with an auger supporting hole 96. The auger supporting hole 96 penetrates through the bearing portion 93 in the left-to-right direction for receiving the cartridge auger 83.

The cartridge auger 83 extends in the left-to-right direction and is positioned within the cylindrical portion 90 of the shutter member 82. The cartridge auger 83 has a left end portion that is rotatably supported to the auger supporting hole 96. As the cartridge auger 83 rotates, the toner supplied from the toner accommodation section 84 to the shutter accommodation section 85 is conveyed, from right to left, toward the accommodation openings 89.

The contact portion 91 is disposed leftward of the bearing portion 93. The contact portion 91 has a substantially disk-shape whose center is coincident with that of the cylindrical portion 90 of the shutter member 82. The contact portion 91 has a diameter identical to that of the cylindrical portion 90 of the shutter member 82.

The auger driving gear 103 is formed in a substantially cylindrical shape extending in the left-to-right direction, and integrally includes a gear portion 107 and the auger supporting portion 108.

The gear portion 107 constitutes a right end portion of the auger driving gear 103. The auger supporting portion 108 extends leftward from the gear portion 107 and has a substantially cylindrical shape.

The auger driving gear 103 is further formed with a through-hole 104 extending in the left-to-right direction. The through-hole 104 coaxially penetrates through the gear portion 107 and the auger supporting portion 108. The through-hole 104 receives a right end portion of the cartridge auger 83 such that the cartridge auger 83 is incapable of rotating relative to the auger driving gear 103 but is slidably movable in the left-to-right direction.

The auger supporting portion 108 has a left end portion provided with a toner seal 105. More specifically, the toner seal 105 is attached to an inner surface of the through-hole 104 at the left end portion of the auger supporting portion 108. The toner seal 105 serves to prevent toner from leaking between the auger supporting portion 108 and the cartridge auger 83.

The auger supporting portion 108 penetrates through the supporting hole 99 of the shutter accommodation section 85 such that the right end portion of the cartridge auger 83 is inserted into the through-hole 104 of the auger supporting portion 108. The auger driving gear 103 is thus capable of rotating relative to the shutter accommodation section 85, but is capable of rotating integrally with the cartridge auger 83.

As shown in FIG. 8, a compression spring 97 is disposed between an inner surface of the right end wall of the shutter accommodation section 85 and an outer surface of a right end portion of the cylindrical portion 90. The compression spring 97 thus normally biases the shutter member 82 leftward due to a biasing force of the compression spring 97.

The shutter member 82 is slidably (linearly) movable in the left-to-right direction within the shutter accommodation section 85.

More specifically, the shutter member 82 is normally biased (slidingly moved) leftward to be positioned leftward within the shutter accommodation section 85 due to the biasing force of the compression spring 97. At this time, the shutter openings 94 are respectively positioned offset leftward from the accommodation openings 89 and in confrontation with the inner circumferential surface of the lower end portion of the shutter accommodation section 85. In other words, the shutter member 82 is in a closed position where the shutter member 82 covers the accommodation openings 89 to prevent toner flow, as shown in FIG. 8.

Figure 10:
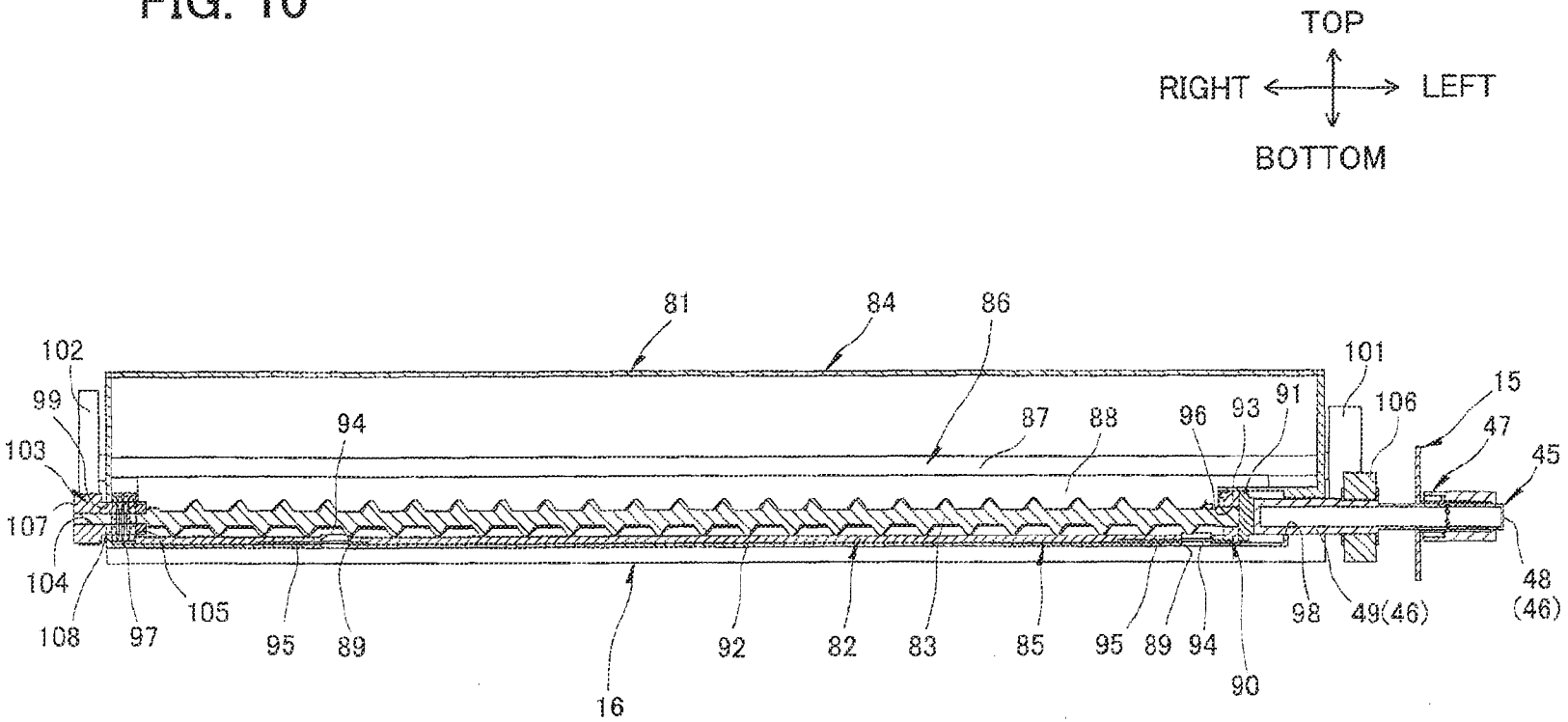
FIG. 10 is an explanatory view of the toner cartridge in a state where the shutter member is in an open position and the operation section is in the first position.

When the shutter member 82 is slidingly moved rightward against the biasing force of the compression spring 97, the shutter openings 94 are in direct confrontation with the accommodation openings 89. In other words, the shutter member 82 is linearly moved from the closed position (leftward) to an open position (rightward) where the shutter member 82 allows toner to flow out of the toner cartridge 16 through the accommodation openings 89, as shown in FIG. 10.

<Gear Mechanism in the Toner Cartridge 16>

The agitator 86 includes an agitator gear 101 and a relay gear 102, as shown in FIG. 8.

The agitator gear 101 is disposed at the left end portion of the agitator shaft 87 so as not to rotate relative to the same. The relay gear 102 is disposed at the right end portion of the agitator shaft 87 so as not to rotate relative to the same. The relay gear 102 meshingly engages the auger driving gear 103.

Figure 9:
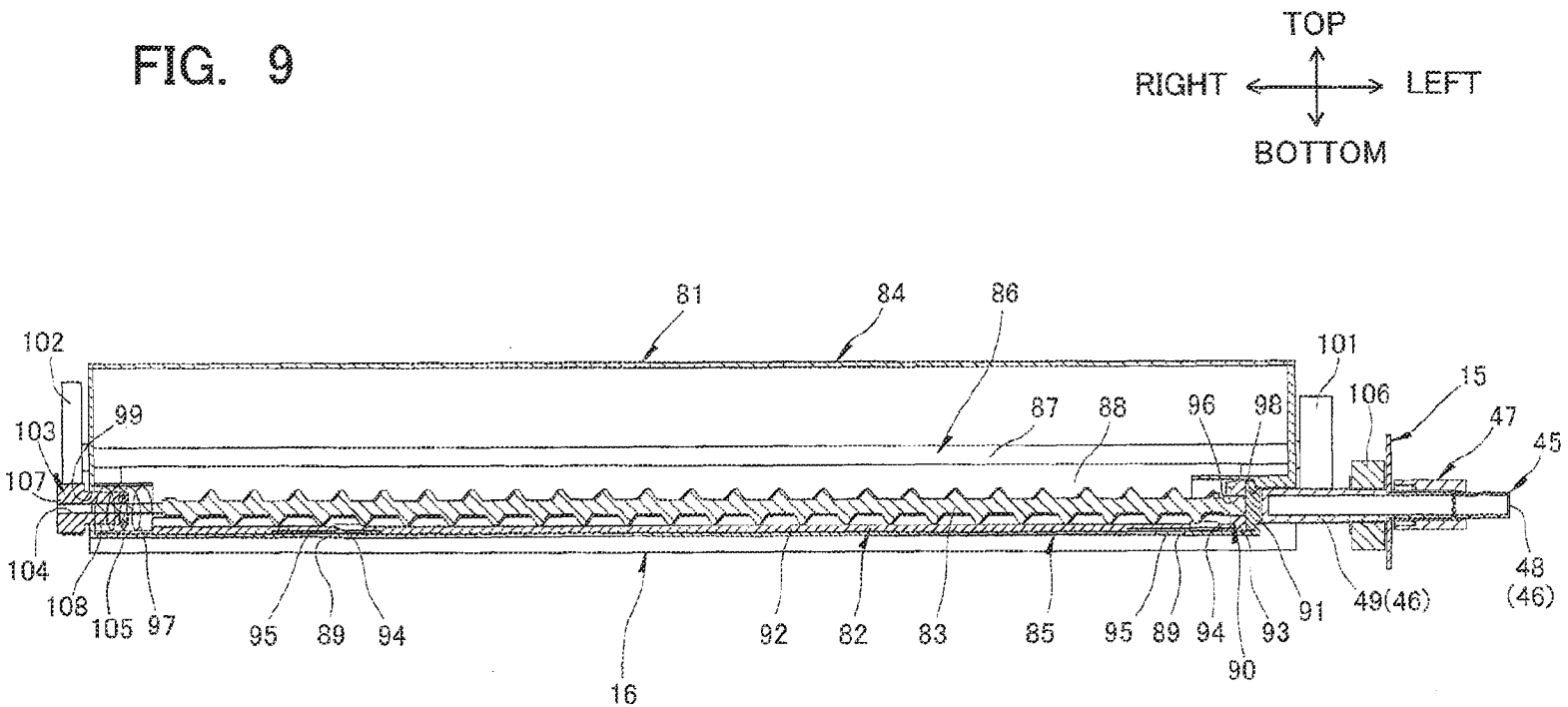
FIG. 9 is an explanatory view of the toner cartridge in a state where the shutter member is in a closed position and the operation section is in the second position.

As shown in FIGS. 9 and 10, an input gear 106 is disposed on the second operation member 49 at a position substantially center thereof in the left-to-right direction. The input gear 106 is positioned rightward of the left side plate 42L of the drawer unit 15 such that the input gear 106 is rotatable relative to the second operation member 49. The input gear 106 is brought into meshing engagement with the agitator gear 101 when the operation member 46 is in the first position.

<Detachment and Mounting of the Toner Cartridge 16>

For mounting the toner cartridge 16 in the main casing 2, the toner cartridge 16 is mounted on the drawer unit 15.

In order for the toner cartridge 16 to be mounted on the drawer unit 15, the user needs to hold the toner cartridge 16 such that the shutter accommodation section 85 faces rearward in a state where the operation member 46 is in the second position. The user then places the toner cartridge 16 above the corresponding developing device unit 19 such that the operation member 46 is positioned leftward of the shutter accommodation section 85. The toner cartridge 16 is then inserted into the drawer unit 15 from above.

When the toner cartridge 16 is placed on the developing device unit 19, the contact portion 91 of the shutter member 82 and the right end portion of the second operation member 49 are brought into confrontation with each other at a position leftward of the shutter accommodation section 85, as shown in FIG. 9.

The user then presses the first operation member 48 of the operation member 46 rightward so that the operation member 46 is moved from the second position to the first position and retained at the first position. Since the shutter member 82 is pushed rightward by the operation member 46, the shutter member 82 is slidingly moved toward the open position from the closed position against the biasing force of the compression spring 97 and is held at the open position. Mounting of the toner cartridge 16 on the drawer unit 15 is thus completed.

In order to mount the toner cartridge 16 in the main casing 2, the user pushes the drawer unit 15 on which the toner cartridge 16 is mounted (the process unit 12) into the main casing 2.

On the other hand, in order to remove the toner cartridge 16 from the main casing 2, the user pulls out the process unit 12 from the main casing 2 and then takes out the toner cartridge 16 from the drawer unit 15.

For removing the toner cartridge 16 from the drawer unit 15, the user first pushes the first operation member 48 of the operation member 46 rightward.

Then, as shown in FIG. 9, the operation member 46 is moved from the first position to the second position and the shutter member 82 is slidingly moved from the open position to the closed position due to the biasing force of the compression spring 97. The shutter member 82 is thus held at the closed position.

The user then pulls the toner cartridge 16 upward from the drawer unit 15 to realize detachment of the toner cartridge 16 from the drawer unit 15.

<Transmission of Driving Force>

As described above, when the toner cartridge 16 is mounted on the drawer unit 15, the operation member 46 is held at the first position and the input gear 106 is brought into meshing engagement with the agitator gear 101.

When the process unit 12 is accommodated within the main casing 2, driving force from the main casing 2 is inputted to the input gear 106. The driving force is then transmitted to the agitator gear 101 from the input gear 106, driving the agitator 86. As the agitator 86 rotates, the driving force is then transmitted to the auger driving gear 103 via the relay gear 102, driving the cartridge auger 83.

<Technical Effects>

As described above, the toner cartridge 16 of the present embodiment includes the shutter member 82 that is slidably movable (linearly movable) between the closed position and the open position in the left-to-right direction. The shutter member 82 is positioned rightward at the open position than at the closed position. The drawer unit 15 includes the operation member 46 that can make linear movements in the left-to-right direction so as to enable the shutter member 82 to move between the closed and open position.

With this configuration, the shutter member 82 of the toner cartridge 16 can be linearly moved from leftward (the closed position) to rightward (the open position) when the user simply moves the operation member 46 linearly from leftward to rightward. That is, the user can operate the operation member 46 from leftward thereof for moving the shutter member 82 between the closed position and the open position. Therefore, the user is not required to manipulate the operation member 46 from above, and the main casing 2 can be prevented from falling down.

Further, the toner cartridge 16 according to the present embodiment has the cartridge auger 83 for conveying toner toward the accommodation openings 89, as shown in FIG. 8. Therefore, the cartridge auger 83 can reliably convey the toner toward the accommodation openings 89.

Further, the shutter member 82 is formed in a substantially hollow cylindrical shape in conformance with the outer profile of the cartridge auger 83, and the cartridge auger 83 is disposed inward of the shutter member 82. Therefore, the cartridge auger 83 can be positioned closer to the accommodation openings 89 such that toner is conveyed efficiently. As a result, the cartridge auger 83 can reliably convey the toner toward the accommodation openings 89. Rigidity of the shutter member 82 can also be enhanced.

Further, as shown in FIG. 8, the shutter member 82 has the bearing portion 93 for supporting the left end portion of the cartridge auger 83. Therefore, a separate member for supporting the left end portion of the cartridge auger 83 can be dispensed with, and the shutter member 82 can be utilized for supporting the left end portion of the cartridge auger 83 in the toner cartridge 16. A reduced number of parts are required to constitute the toner cartridge 16.

Further, as shown in FIG. 10, the operation member 46 is provided with the input gear 106 for inputting the driving force from the main casing 2 when the shutter member 82 is in the open position. The agitator 86 has the left end portion on which the agitator gear 101 is provided such that the agitator 86 rotates integrally with the agitator gear 101. The agitator gear 101 meshingly engages the input gear 106 when the operation member 46 moves the shutter member 82 to the open position. The agitator 86 has the right end portion on which the relay gear 102 is provided such that the relay gear 102 integrally rotates with the agitator 86. The cartridge auger 83 has the right end portion on which the auger driving gear 103 engageable with the relay gear 102 is disposed such that the auger driving gear 103 cannot rotate relative to the cartridge auger 83 but can rotate relative to the right side wall of the cartridge frame 81 of the toner cartridge 16.

With this configuration, the driving force inputted to the input gear 106 is transmitted to the agitator gear 101, thereby driving the agitator 86. As the agitator 86 rotates, the driving force is then transmitted to the auger driving gear 103 via the relay gear 102, thereby driving the cartridge auger 83. In other words, the driving force inputted for driving the agitator 86 can also be used for driving the cartridge auger 83. In this way, the above-described simple configuration can realize the transmission of the driving force to the cartridge auger 83 that is accommodated within the shutter member 82.

Further, according to the toner cartridge 16 of the present embodiment, the cartridge auger 83 is supported to the shutter member 82 and integrally moves with the shutter member 82, as shown in FIGS. 9 and 10. Therefore, the operation member 46 can simultaneously push the shutter member 82 and the cartridge auger 83. Further, rigidity of the shutter member 82 can be enhanced to prevent the shutter member 82 from being distorted due to the pressing force applied from the operation member 46. Preventing distortion of the shutter member 82 can lead to prevention of the movement of the shutter member 82 from being obstructed. The shutter member 82 can be therefore smoothly opened and closed. Furthermore, sealing between the cartridge auger 83 (the left end portion of the cartridge auger 83) and the shutter member 82 (the bearing portion 93) can be easily done.

Further, the compression spring 97 is disposed at the right end portion of the shutter accommodation section 85 for biasing the shutter member 82 leftward, as shown in FIG. 10. The operation member 46 serves to press the left end portion of the shutter member 82 (the contact portion 91) rightward against the biasing force of the compression spring 97.

Therefore, when the toner cartridge 16 is taken out from the drawer unit 15 and the shutter member 82 is released from the pressing by the operation member 46, the shutter member 82 is pushed leftward to be in the closed position due to the biasing force of the compression spring 97. As a result, the shutter member 82 can be reliably moved to the closed position when the toner cartridge 16 is removed from the drawer unit 15.

Further, in the present embodiment, pressing the operation member 46 in the second position rightward leads to bringing the shutter member 82 to the open position, while pressing the operation member 46 in the first position rightward leads to bringing the shutter member 82 to the closed position. In other words, manipulating the operation member 46 in a single direction (rightward) enables the shutter member 82 to be opened and closed.

Suppose that a pair of operation members 46 is disposed on both widthwise ends of the drawer unit 15. The operation member 46 on the left needs to be pushed rightward to move the shutter member 82 to the open position and the operation member 46 on the right needs to be pushed leftward to move the shutter member 82 to the closed position. In contrast, according to the toner cartridge 16 of the present embodiment, pressing operation member 46 in a single direction (rightward) allows the shutter member 82 to move between the open position and the closed position. Operability of the operation member 46 can therefore be enhanced. At the same time, the main casing 2 can also be effectively prevented from falling down.

Although the present invention has been described with respect to the specific embodiment thereof, it will be appreciated by one skilled in the art that a variety of changes may be made without departing from the scope of the invention.

What is claimed is:

1. An image forming device comprising:

a main body;

a holding member movable relative to the main body between an accommodated state and a withdrawn state, the holding member being accommodated within the main body in the accommodated state and being pulled out from the main body in the withdrawn state, the holding member having therein a plurality of photosensitive members and a plurality of developing devices each corresponding to each photosensitive member, each photosensitive member extending in a first direction;

a plurality of operation members disposed on the holding member, each operation member extending in the first direction and disposed in one-to-one correspondence with the plurality of developing devices; and a plurality of developer cartridges detachably mountable on the holding member in one-to-one correspondence with the plurality of developing devices, each developer cartridge extending in the first direction and storing developer therein, each developer cartridge being formed with an opening and having a shutter member linearly movable between an open position and a closed position in the first direction, the shutter member opening the opening at the open position to allow the developer to flow to the corresponding developing device and closing the opening at the closed position to prevent the developer from flowing out of the developer cartridge, each operation member being linearly movable in the first direction to move the shutter member between the open position and the closed position.

2. The image forming device according to claim 1, wherein each developer cartridge further comprises a screw auger extending in the first direction to convey the developer toward the opening.

3. The image forming device according to claim 2, wherein the shutter member has an outer profile in conformance with that of the screw auger and the screw auger is disposed inside the developer cartridge and inward of the shutter member.

4. The image forming device according to claim 3, wherein the shutter member includes a supporting member, the screw auger having one end in the first direction supported by the supporting member.

5. The image forming device according to claim 2, wherein each developer cartridge further includes an agitator for agitating the developer, the agitator extending in the first direction and having a first end and a second end both rotatably supported by the developer cartridge; and wherein each screw auger has one end in the first direction to which an auger gear is connected, the auger gear being incapable of rotating relative to the screw auger but capable of rotating relative to the developer cartridge; and wherein each operation member includes an input gear to which driving force from the main body is inputted when the shutter member is in the open position; and wherein each agitator has an agitator gear on the first end and a relay gear on the second end, the agitator being incapable of rotating relative to the agitator gear and the relay gear, the agitating gear being brought into meshing engagement with the input gear when the operation member moves the shutter member to the open position, the relay gear being in meshing engagement with the auger gear.

6. The image forming device according to claim 2, wherein the screw auger is disposed in each developing cartridge so as to be movable integrally with the shutter member.

7. The image forming device according to claim 1, wherein each developer cartridge further includes a biasing member disposed at one end of the developer cartridge in the first direction, the biasing member biasing the shutter member toward another end opposite to the one end of the developer cartridge in the first direction; and wherein each operation member functions to press the shutter member toward the one end against biasing force of the biasing member.

8. The image forming device according to claim 7, wherein each operation member is movable between a first position and a second position, the shutter member being placed in the open position when the operation member is in the first position and in the closed position when the operation member is in the second position; and wherein the operation member is moved from the second position to the first position to bring the shutter member in the open position as a result of the operation member at the second position being pressed in the first direction; and wherein the operation member is prevented from being moved back to the second position to retain the shutter member at the open position as a result of the operation member at the first position being released from being pushed in the first direction; and wherein the operation member is moved from the first position to the second position to bring the shutter member in the closed position as a result of the operation member in the first position being pushed in the first direction.

* * * * *